United States Patent [19]

Benedict et al.

[11] Patent Number: 4,825,667

[45] Date of Patent: May 2, 1989

[54] CRYOGENIC COOLING SYSTEM

[75] Inventors: Becky A. Benedict, Denver; James M. Lester, Boulder; Delvern D. Linenberger, Denver, all of Colo.

[73] Assignee: Ball Corporation, Muncie, Ind.

[21] Appl. No.: 154,820

[22] Filed: Feb. 11, 1988

[51] Int. Cl.[4] ..... F25B 19/00

[52] U.S. Cl. ..... 62/51.2; 62/3.2; 62/264; 62/467; 165/156; 165/168

[58] Field of Search ..... 62/514 JT, 113, 513, 62/3, 467, 264; 165/168, 156

[56] References Cited

U.S. PATENT DOCUMENTS

| | | | |
|---|---|---|---|
| 2,699,043 | 1/1955 | Kramer | 62/513 |
| 2,764,876 | 10/1956 | Parcaro | 62/513 |
| 3,613,387 | 10/1971 | Collins | 62/513 |

*Primary Examiner*—Ronald C. Capossela
*Attorney, Agent, or Firm*—Gilbert E. Alberding

[57] ABSTRACT

A compact, reliable, and efficient cryogenic cooling system that can provide cryogenic cooling for a variety of desirable uses. The system is particularly desirable to provide cooling for infrared detectors in temperature ranges from 40K to 77K, and may be advantageously used in multi-stage systems to produce temperatures as low as 5K. In cryogenic cooling systems using a compressor and Joule-Thomson valves, working fluids, such as nitrogen, can be precooled to temperatures substantially below 165K at the input to a Joule-Thomson valve, and the power input to systems of our invention providing cooling 77K, for example, can be reduced by a factor of 4.5. In closed loop systems, a precooler between the compressor and the Joule-Thomson valve cools the working fluid by heat exchange between the working fluid flowing from the compressor to the Joule-Thomson valve and the working fluid returning from the load to the compressor, and by a further heat exchange between the working fluid flowing from the compressor to the Joule-Thomson valve and a cooling means conductively coupled to the working fluid. The cooling means can comprise a plurality of conductive heat paths-forming means that are conductively coupled to the working fluid flowing from the compressor to the Joule-Thomson valve and a plurality of thermo-electric coolers for removing heat from the conductive heat path-forming means.

17 Claims, 2 Drawing Sheets

CRYOGENIC COOLING SYSTEM

TECHNICAL FIELD

This invention relates to systems to generate cooling at cryogenic temperatures and, more particularly, to cryogenic cooling systems including heat exchangers, thermoelectric coolers, and Joule-Thomson valves.

Cryogenic cooling systems are used in many applications to cool loads performing useful functions. For example, infrared radiation detectors must frequently be maintained at cryogenic temperatures for satisfactory operation; and cryogenic cooling systems must be used to achieve these very low temperatures. Where such detectors are employed in spacecraft, it is necessary that the cryogenic cooling system occupy the minimum possible space, contribute a minimum possible mass to the spacecraft, and consume a minimum of power in its operation. The complexities involved with placing a spacecraft with such a detector in orbit and maintaining its operation while in space simply permit no wasteful use of space, mass, or power. In addition, thousands of cryogenic cooling systems are used by the military for ground, ship, and airborne infrared radar detectors.

BACKGROUND ART

In the past, Stirling-cycle machines have been used to achieve cryogenic temperatures because they have been well-developed and provide reasonable efficiency in this application. Stirling-cycle machines, however, are somewhat unreliable and are subject to vibration which disturbs the detectors being cooled.

In the past, systems using compressors and Joule-Thomson valves have not been used in such practical applications because of the substantially greater power input requirement and lower efficiency of such systems.

The use of cooling systems employing a Joule-Thomson valve has been further complicated by the properties of available working fluids. Nitrogen is a desirable working fluid in many such systems because its properties permit it to operate satisfactorily from room temperature to 77K, and thus permit single-stage systems (i.e., systems using a single working fluid). The extent of cooling available from systems using Joule-Thomson valves, however, depends on the working gas properties at the warm end of the system; and unfortunately, the properties of nitrogen are such that when starting from room temperature, high power inputs have been required to obtain adequate cooling during operation. Thus, in the past, Stirling-cycle machines have been used almost exclusively in cryogenic cooling systems to produce temperatures higher than about 60K.

DISCLOSURE OF THE INVENTION

The invention provides a compact, reliable, and efficient cryogenic cooling system that can provide cryogenic cooling for a variety of desirable uses. The system of this invention is particularly desirable to provide cooling for infrared detectors in the temperature range from 40K to 77K, and may be advantageously used in multi-stage systems to produce temperatures as low as 5K.

Our invention stems from the discovery of a system to efficiently precool a working fluid such as nitrogen prior to its expansion at a Joule-Thomson valve, and to greatly reduce the power required to run a Joule-Thomson-type cooling system. With a system incorporating our invention, working fluids, such as nitrogen, can be cooled to temperatures substantially below 200K in the heat exchanger preceding the Joule-Thomson valve; and the power input to systems providing cooling at 77K, for example, can be reduced by a factor of 4.5. The precooling that may be obtained with systems of our invention also reduces the temperature decrease requirement for the Joule-Thomson valve, but, more importantly, moves the starting temperature for operation of the Joule-Thomson cycle to a point where the properties of nitrogen are substantially more favorable. In our invention, such precooling can be effected without an offsetting power increase or a complication of moving mechanical parts of the cooler.

In our invention, we have provided a means placed between the compressor and the Joule-Thomson valve adapted to precool the working fluid by heat exchange between the working fluid flowing from the compressor to the Joule-Thomson valve and the working fluid returning from the load to the compressor. Precooling is further achieved by additional heat exchange between the working fluid flowing from the compressor to the Joule-Thomson valve and a cooling means conductively coupled to the working fluid. In a preferred embodiment of our invention, the precooling means forms a plurality of conductive heat paths that are conductively coupled to the working fluid flowing from the compressor to the Joule-Thomson valve and a plurality of means for removing heat from the conductive heat path-forming means. Preferably, a plurality of thermoelectric coolers is provided for removing the heat from the conductive heat path-forming means; and the plurality of heat path-forming means is spaced and conductively coupled to the working fluid flowing from the compressor to the Joule-Thomson valve adjacent to the cold end of the precooling means.

In the operation of our cryogenic cooling system, the working fluid is first compressed for delivery to the load to be cooled and directed to a cooling stage. In the cooling stage, the compressed working fluid is placed in a heat transfer relationship with working fluid leaving the load to remove heat from the compressed working fluid. Heat is further transferred from the compressed working fluid before it is directed to the Joule-Thomson valve by the cooling means conductively coupled to the working fluid. In the preferred embodiment, thermoelectric cooling removes heat from the compressed working fluid leaving the compressor and, in conjunction with the heat transfer from the compressed working fluid to the working fluid leaving the load, efficiently precools the compressed working fluid for delivery to the expansion valve.

By the addition of a relatively small input power in the precooling stage to the input power of the compressor, cryogenic cooling systems of our invention can equal the efficiency of the best small Stirling-cycle coolers and provide cooling systems capable of developing temperatures down to 5K with less than half the power requirement of the most efficient complex coolers under development.

Further features and advantages of the invention will be apparent from the drawings and the more detailed description that follows.

BEST MODE FOR CARRYING OUT THE INVENTION

Figure 1:
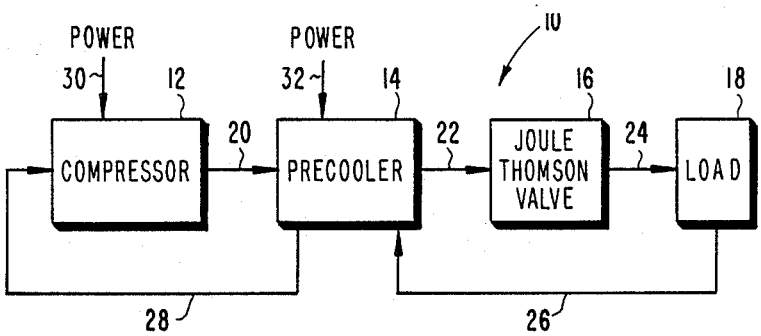
FIG. 1 is a diagrammatic drawing of a cryogenic cooling system of our invention.

FIG. 1 is a diagrammatic representation of a closed loop cryogenic cooling system 10 of our invention. As shown in FIG. 1, our cryogenic cooling system includes a compressor 12, a precooler 14, and a Joule-Thomson valve 16. The system is adapted to deliver a working fluid at cryogenic temperatures to a load 18.

A system power 30 is supplied to compressor 12 to compress the working fluid and to deliver it, in order, to precooler 14, Joule-Thomson valve 16, and load 18 over paths 20, 22, and 24, respectively, and to return the working fluid from load 18 to the precooler and hence to the compressor over paths 26 and 28, respectively.

A working fluid, typically gaseous nitrogen, neon or helium is compressed in compressor 12 and delivered over path 20 to precooler 14 which comprises a cooling stage for the working fluid. In the cooling stage 14, the compressed working fluid is placed in a heat transfer relationship with the working fluid leaving the load over path 26 prior to its exit from the cooling stage and, in the closed loop system shown in FIG. 1, prior to its delivery to the compressor over path 28. By heat transfer relationship, we mean that in the cooling stage, the working fluid travelling from path 20 to path 22 travels to a heat exchanging structure within precooler 14 which is exposed to the working fluid travelling from path 26 to path 28 and that in the heat-exchanging structure within precooler 14, heat is transferred from the compressed working fluid travelling from path 20 to path 22 to the working fluid travelling from path 26 to path 28.

In addition, the cooling stage defined by precooler 14 provides further cooling means conductively coupled to the working fluid as it travels from path 20 to path 22. By conductively coupled, we mean that heat-exchanging structure within precooler 14, through which the compressed working fluid travels from path 20 to path 22, defines a conductive heat path that transmits heat from the compressed working fluid to the cooling means for removal from the system. In systems of the invention, the cooling means which is conductively coupled to the compressed working fluid within precooler 14 is preferably thermo-electric means conductively coupled to the working fluid and powered from outside the system as indicated at 32 of FIG. 1.

The system thus transfers heat from the compressed working fluid to be directed to Joule-Thomson valve 16 to the working fluid leaving the load 18 and through the cooling means conductively coupled to the compressed working fluid within precooler 14 to outside of the system. Working fluid can thus be delivered to Joule-Thomson valve 16 at temperatures that may be 100 to 200K lower than the working fluid temperature at the exit of the compressor. Upon expansion through the Joule-Thomson valve, working fluid temperatures can be reduced to cryogenic level. For example, the system of FIG. 1 can provide a supply of liquid nitrogen over path 24 at temperatures of about 77K and can provide such cryogenic materials efficiently in sufficient volume to maintain loads such as infrared detectors at cryogenic temperatures.

Figure 2:
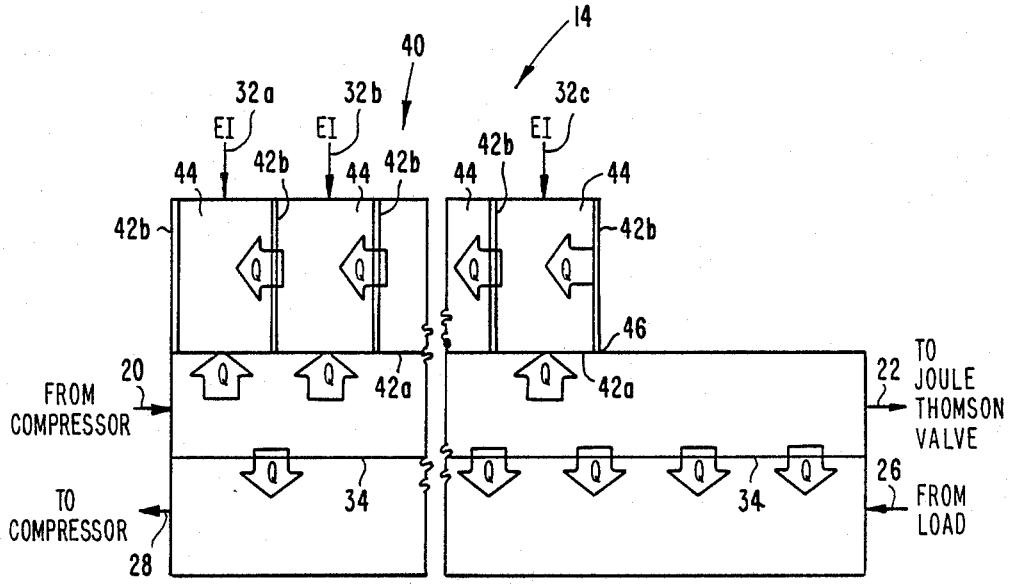
FIG. 2 is a diagrammatic representation of the precooler of the system shown in FIG. 1.

FIG. 2 illustrates, in diagrammatic fashion, the manner in which heat is transferred within cooling stage 14 of FIG. 1. Working fluid from compressor 12 enters cooling stage 14, as indicated at 20, and leaves the cooling stage, as indicated at 22 of FIG. 2. Upon leaving load 18, working fluid is directed to cooling stage 14 from the load, as indicated at 26, and leaves cooling stage 14, as indicated in 28. Within cooling stage 14, the working fluid travelling from 20 to 22 is in heat exchange relationship with the working fluid travelling from 26 to 28, separated only by a thermally conductive, heat exchanging interface 34 as schematically indicated in FIG. 2. Heat Q is transferred from the compressed working fluid from the compressor to the working fluid from the load through conductive interface 34, as shown by the plurality of downwardly pointing arrows Q. In the preferred closed-loop embodiment, the working fluid leaving load 18 is directed to cooling stage 14 and then from there to compressor 12.

In addition to the cooling provided within cooling stage 14 by the working fluid leaving the load 18, i.e., travelling from 26 to 28, heat is also removed from the compressed working fluid by a cooling means 40 conductively coupled to the compressed working fluid. As illustrated in FIG. 2, cooling means 40 includes a conductive heat path 42 which absorbs heat from the compressed working fluid, as indicated by the plurality of upwardly pointing arrows Q in FIG. 2. Conductive heat path 42 comprises a portion **42*a* adjacent the working fluid and one or more portions 42*b* to conduct heat away from the compressed working fluids to be removed from the system. In preferred embodiments, a plurality of conductive portions 42*b* is spaced along the path of the compressed working fluid adjacent the warm (or compressed) end of cooling stage 14 to more efficiently remove heat from the working fluid as it travels from the warm end (shown at the left in FIG. 2) to the cool end (shown at the right of FIG. 2) of the cooling stage. In the preferred embodiment, thermoelectric coolers 44 are interposed between adjacent pairs of the conductive heat path-forming means 42*b* and are each connected with a source of electric power EI 32*a–c* to remove heat from the conductive heat path-forming means 42*b* and to transfer heat from the cool end of cooling stage 14 toward the warm end of cooling stage 14, as indicated by the leftwardly pointing arrows Q of FIG. 2. In applications where design permits, the conductive heat path-forming means 42*b* may be extended from precooler 14** to form black-body-radiating means to radiate the heat absorbed from the compressed working fluid into space, thereby removing it from the system. Such radiative precooling systems cannot be used in practical non-space applications and can only be used where spacecraft design permits. It is preferable that the radiative coolers be remotely located from the Joule-Thomson valve, if such a location is possible without loss of the low precooling temperature of the compressed working fluid while passing through the interconnection between the precooler and the Joule-Thomson valve.

In the cooling stage of FIG. 2, the compressed working fluid entering the cooler at 20 from the compressor is typically at a temperature of about 300K. In applications using nitrogen as the working fluid, for example, the working fluid entering the precooler at 26 from the load is typically on the order of 77K. In systems without a cooling means 40, in which heat is transferred from the compressed working fluid travelling from 20 to 22 only through conductive interface 34 to the working fluid travelling from 26 to 28, the temperature difference between the working fluid leaving cooling stage 14 at 22 and the working fluid entering cooling stage 14 at 26 (at the cool end of the cooling stage) was unavoidably large because of the properties of the working fluid and the cooling load. Thus, the working fluid leaving cooling stage 14 was delivered to the Joule-Thomson valve at temperatures which frequently prevented efficient operation of the system. By providing cooling means 40, heat can be removed from the compressed working fluid through conductive cooling means 42; and the temperature of the compressed working fluid adjacent to cold end of cooling means 40, indicated in FIG. 2 by the numeral 46, can be reduced to temperatures on the order of 200K. The temperature of the compressed working gas is then further reduced by heat transfer through conductive interface 34 as the compressed cooling gas is delivered from adjacent cold end 46 of cooling means 40 to point 22 where it exits the cooling stage. The removal of heat from the compressed working fluid by cooling means 40 thus permits the cryogenic cooling system of the invention with its Joule-Thomson valve to provide substantial quantities of working fluid at cryogenic temperatures of 77K using nitrogen, and with temperatures as low as 40K in two-stage systems using nitrogen and neon as the working fluids.

As shown in FIG. 2, cooling means 40 preferably includes a plurality of conductive heat path-forming means **42*b* for removing heat from compressed working fluid; and, as indicated in FIG. 2, the plurality of conductive heat path-forming means 42*b* is located adjacent the warm end of cooling stage 14 and spaced along the flow path of the compressed working fluid in such a manner as to develop an effective temperature reduction of the compressed working fluid as it flows through cooling stage 14**.

Figure 3:
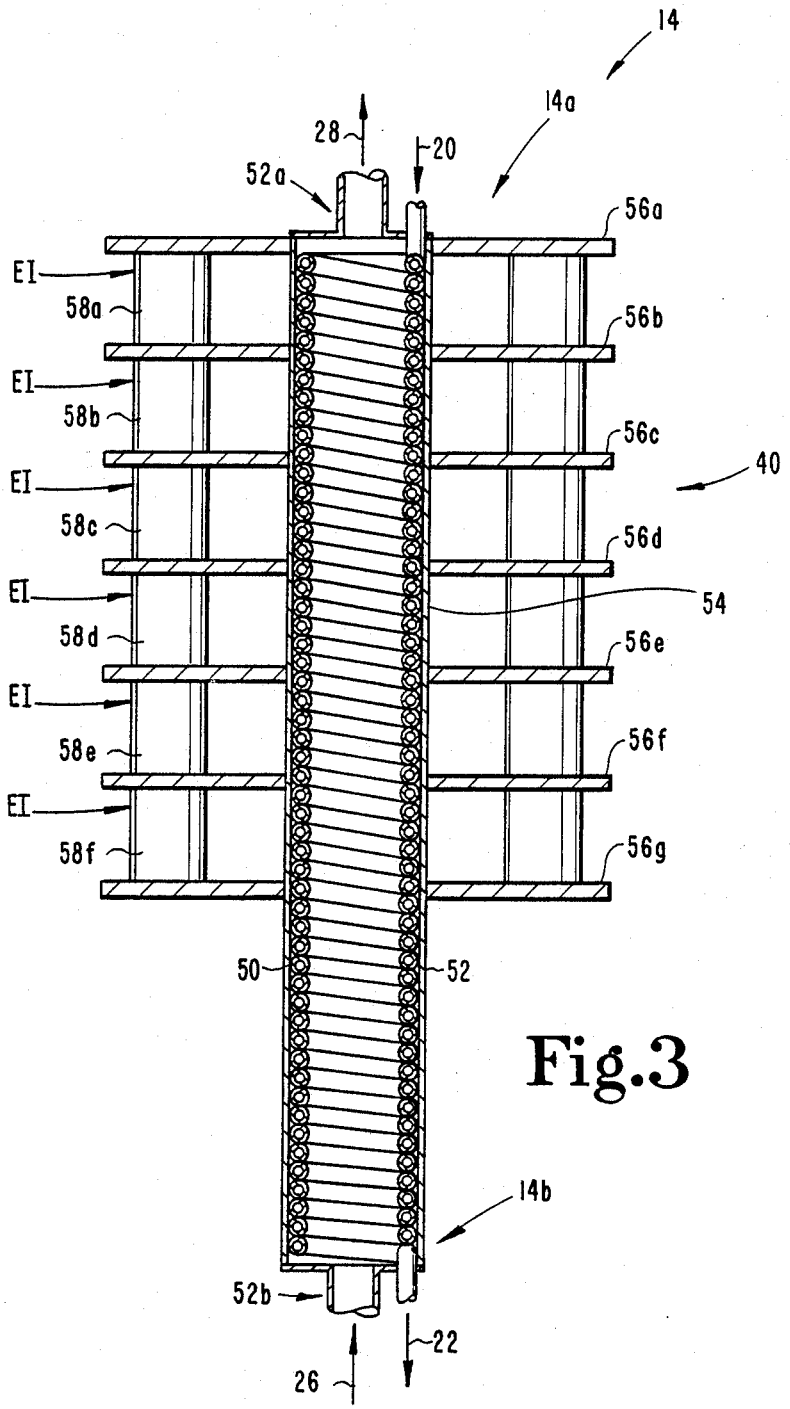
FIG. 3 is a cross-sectional view of one embodiment of a precooler for use in the system of FIG. 1.

FIG. 3 is a cross-sectional view of a precooler 14 forming a cooling stage of cryogenic cooling system 10 of this invention. Precooler 14 includes a first conduit 50 for compressed working fluid travelling between the compressed working fluid inlet 20 to the compressed working fluid outlet 22. As indicated in FIG. 3, first conduit 50 preferably forms an extended path having a substantial heat-exchanging surface area to provide a large area conductive interface, corresponding to interface 34 of FIG. 2. The precooler includes a second conduit 52 for working fluid flowing from the load connection 26 of the precooler to the exit connection 28 of the precooler. This first conduit 50 and second conduit 52 thus form a heat exchanger within precooler 14 which places the compressed working fluid entering inlet 20 in heat transfer relationship with the working fluid leaving the load. The walls of first conduit means 50 form an extended thermally conductive interface exposed to the cold working fluid travelling from a connection 26 to connection 28, and heat is transferred from the compressed working fluid as it travels from the connection 20 to connection 22.

Heat is further transferred from the compressed working fluid by the structure forming cooling means 40. Cooling means 40 includes a first heat path-forming means 54 conductively coupled to first conduit 50. By conductively coupled, we mean first conduit 50 and first heat path-forming means 54 are provided with an interface of high thermal conductivity (low thermal resistance) so that the temperatures of the walls of the first conduit 50 are substantially equal, or only a few degrees removed from, the temperatures of first heat path-forming means 54. For both heat-forming paths 52 and 54, it is important to understand that high conductivity is desired across the thickness of the material and low conductivity is desired along the length of the material. Cooling means 40 of precooler 14 is further provided with a plurality of second heat path-forming means **56*a* through 56*g*. Each of the plurality of second heat path-forming means 56*a–g* is conductively coupled to first heat path-forming means 54. Thus, in precooler 14, heat is also transferred from the compressed working fluid through the wall of conduit 50, first heat path-forming means 54, and second heat path-forming means 56*a–g* for removal from the system. Each second heat path-forming means 56*a* through 56*g* because of its high thermal conductivity constitutes an essentially isothermal body. As shown in FIG. 3, cooling means 40 and, more particularly, the plurality of heat path-forming means 56*a* through 56*g* are located adjacent the warm end (i.e., the top as shown in FIG. 3) of precooler 14. The plurality of heat path-forming means 56*a–g* is preferably spaced non-uniformly from a warm end 14*a* along the path of first conduit 50 toward a cold end 14*b* of the precooler and in such spacing as required to maximize the efficiency of the precooler 14**.

In the preferred embodiment of the precooler, a plurality of thermo-electric coolers **58*a* through 58*f* is located between the plurality of second heat path-forming means 56*a* through 56*g*. As shown in FIG. 3, each of thermo-electric coolers 58 is conductively coupled with the adjacent heat path-forming means 56. That is, thermo-electric cooler 58*a* is conductively coupled to heat path-forming means 56*a* and 56*b* to form a conductive heat path of high thermal conductivity between thermo-electric cooler 58*a* and each of second heat path-forming means 56*a* and 56*b*. In like manner, thermo-electric cooler 58*b* is conductively coupled to heat path-forming means 56*b* and 56*c*; thermo-electric cooler 58*c* is conductively coupled to heat path-forming means 56*c* and 56*d*; thermo-electric cooler 58*d* is conductively coupled to heat path-forming means 56*d* and 56*e*; thermo-electric cooler 58*e* is conductively coupled to heat path-forming means 56*e* and 56*f*; and thermo-electric cooler 58*f* is conductively coupled to heat path-forming means 56*f* and 56*g***.

Each of the thermo-electric coolers **58*a* through 58*f* is electrically connected to a source of power EI to transfer heat in the direction of warm end 14*a* of precooler 14. Thus, starting from cold end of 14*b* of precooler 14, thermo-electric cooler 58*f* transfers heat from heat path-forming means 56*g* to heat path-forming means 56*f*; thermo-electric cooler 58*e* transfers heat from heat path-forming means 56*f* to heat path-forming means 56*e*; thermo-electric cooler 58*d* transfers heat from heat path-forming means 56*e* to heat path-forming means 56*d*; thermo-electric cooler 58*c* transfers heat from heat path-forming means 56*d* to heat path-forming means 56*c* thermo-electric cooler 58*b* transfers heat from heat path-forming means 56*c* to heat path-forming means 56*b*; and thermo-electric cooler 58*a* transfers heat from heat path-forming means 56*b* to heat path-forming means 56*a***.

In a six-stage cooler, as shown in FIG. 3, thermo-electric coolers 58 can form a plurality of generally isothermal sectors providing a substantial reduction in the temperature of the compressed working fluid in the first conduit 50. Typically, in such a six-stage cooler, heat path-forming means 56*a* through 56*g* form typically isothermal regions of about the following temperatures:

56*a*—300K;
56*b*—270K;
56*c*—240K;
56*d*—215K;
56*e*—190K;
56*f*—170K;
56*g*—165K.

These temperatures are illustrative of typical operation of precooler 14 in a system using nitrogen as a working fluid to provide load cooling temperatures of 77K. As a result of the reduction in the temperature of the compressed working fluid in conduit 50 to a temperature of about 165K adjacent heat path-forming means 56*g* at the cold end of cooling means 40, cryogenic cooling system 10 of the invention can provide an adequate supply of nitrogen at 77K from a Joule-Thomson valve to cool loads such as infrared radiation detectors.

For example, with cryogenic cooling system 10 using precooler 14 of the type illustrated in FIG. 3, one watt of cooling at 77K can be provided with an input power of 15 watts to thermo-electric coolers 58*a* through 58*f* and 30 watts of power to the compressor 12. The performance of such a unit is equal to the best of the small Stirling-cycle engines that have been used, and several times better than the military coolers now in use. Cryogenic cooling systems of our invention can operate with about half the power of the most efficient, complex spacecraft coolers under development. The invention permits Joule-Thomson systems to handle loads in temperature ranges from 30K to 77K. Such a system, used with neon gas in six or more isothermal stages, can provide quick cooling to less than 30K. In addition, the invention can be used in multi-stage coolers including a first stage using nitrogen gas to provide cryogenic temperatures of 77K and a second, colder stage using neon gas as a working fluid to provide cryogenic temperatures on the order of 40K. The invention can also be used in multistage systems with helium to provide temperatures of about 5K.

In manufacturing a precooler of the type shown in FIG. 3, the first conduit means may be stainless steel tubing that is tightly wound into a helix as shown in FIG. 3. The tubing, in a small system adapted for use in spacecraft, should have an inside diameter of about 0.050 inch (0.127 cm.) and a wall thickness of about 0.005 inch (0.013 cm.). The tightly wound helix of tubing comprising first conduit 50 can be inserted into cylindrical tube forming second conduit 52. Preferably, first conduit 50 is expanded within the tube forming second conduit 52 in such a manner that the outer periphery of each coil of the helix of first conduit 50 contacts the interior surface of the tube forming second conduit 52. The tubing forming second conduit 52 is preferably stainless steel and is provided with closures 52*a* and 52*b* at each end to provide various connections 20, 22, 26 and 28. Second conduit 52 may thus be formed of stainless steel tubing having a diameter of 0.75 inch (1.90 cm.) and a wall thickness in the range from about 0.005 inch (0.013 cm.) to about 0.015 inch (0.038 cm.).

Each of the second heat path-forming means 56*a* through 56*g* may be an annular copper disk with a central opening sized to tightly fit about second conduit 52. Each of the plurality of annular disks 56*a* through 56*g* can have a thickness of about 0.040 inch (0.10 cm.) to provide a conductive heat path with high thermal conductivity to provide essentially an isothermal plane. The copper annular disks 56*a* through 56*g* may be soldered to tube 52 in a manner well-known in the art.

Each of the plurality of thermo-electric coolers 58*a* through 58*f* is a semi-conductor thermoelectric cooler of a type manufactured by Marlow Industries. If advisable, the precooler may be provided with insulation adjacent its cold end.

The invention is illustrated and described in a presently preferred embodiment. It is to be understood, however, that modifications and variations of the invention may be effected without departing from the scope of the invention as set forth in the following claims.

We claim:

1. A cryogenic cooling system, comprising:

a compressor adapted to compress a working fluid for subsequent expansion at cryogenic temperatures;

a valve adapted for isenthalpic expansion of the working fluid at cryogenic temperatures;

means between the compressor and the expansion valve adapted to precool the working fluid by heat exchange between the working fluid flowing from the compressor to the expansion valve and the working fluid leaving the load and by heat exchange between the working fluid flowing from the compressor to the expansion valve; and second cooling means thermally coupled to the working fluid, said second cooling means comprising means forming one or more conductive heat paths conductively coupled to said working fluid flowing from the compressor to the expansion valve and thermo-electric cooling means in heat transfer relationship with the conductive heat path-forming means.

2. The system of claim 1 wherein the means forming one or more conductive heat paths comprises a plurality of means forming conductive heat paths that are conductively coupled to said working fluid flowing from the compressor to the expansion valve and a plurality of thermo-electric cooling means is in heat transfer relationship with the plurality of means forming conductive heat paths for removing heat from the conductive heat path-forming means.

3. Tho system of claim 2 wherein the plurality of heat path-forming means is spaced and conductively coupled to the working fluid flowing from the compressor to the expansion valve to form a plurality of substantially isothermal heat paths along the flow path of the working fluid adjacent the warm end of the means to precool the working fluid.

4. The system of claim 3 wherein said means to precool the working fluid includes a first conduit for the working fluid flowing from the compressor to the expansion valve and a second conduit for the working fluid flowing from the load to the compressor, said first and second conduits forming a heat exchanger for the fluids they carry, wherein said plurality of heat path-forming means comprises a plurality of heat conductive plates conductively coupled to said first conduit to form a plurality of heat paths of high thermal conductivity, and said plurality of thermo-electric cooling means is conductively coupled to said plurality of heat conductive plates so that upon receipt of electrical energy, said plurality of thermo-electric cooling means removes heat from said heat conductive plates, said first conduit and said working fluid and transfers said heat to the warm end of said means to precool the working fluid.

5. In a closed loop system adapted to deliver a working fluid at a cryogenic temperature to a load to be cooled, including a compressor and a Joule-Thomson valve, the improvement comprising means between the compressor and the Joule-Thomson valve adapted to precool the working fluid by heat exchange between the working fluid flowing from the compressor to the Joule-Thomson valve and the working fluid returning from the load to the compressor and by heat exchange from the working fluid flowing from the compressor to the Joule-Thomson valve and a second cooling means thermally coupled to the working fluid, said second cooling means comprising a plurality of means forming conductive heat paths that are conductively coupled to said working fluid flowing from the compressor to the Joule-Thomson valve and a plurality of thermo-electric cooling means in heat transfer relationship with the plurality of conductive heat path-forming means.

6. The system of claim 5 wherein the plurality of heat path-forming means is spaced and conductively coupled to the working fluid flowing from the compressor to the Joule-Thomson valve along the flow path of the working fluid adjacent the warm end of the means to precool the working fluid.

7. The system of claim 6 wherein said means to precool the working fluid includes a first conduit for the working fluid flowing from the compressor to the Joule-Thomson valve and a second conduit for the working fluid flowing from the load to the compressor, said first and second conduits forming a heat exchanger for the fluids they carry, wherein said plurality of heat path-forming means comprises a plurality of heat conductive plates conductively coupled to said first conduit to form a plurality of heat paths of high thermal conductivity, and said plurality of thermo-electric cooling means is conductively coupled to said plurality of heat conductive plates so that upon receipt of electrical energy, said thermo-electric cooling means removes heat from said heat conductive plates, said first conduit and said working fluid and transfers said removed heat to the warm end of said means to precool the working fluid.

8. A precooler for a cryogenic cooling system comprising:

means forming a first conduit to carry a working fluid from a warm end of said precooler to a cold end of said precooler;

means forming a second conduit in heat transfer relationship with said first conduit;

heat conductive means in heat transfer relationship with said first conduit adjacent the warm end of said precooler; and means to remove heat from said heat conductive means comprising a plurality of thermo-electric cooling means conductively coupled to said heat conductive means and arranged to transfer heat toward the warm end of the precooler.

9. The precooler of claim 8 wherein said heat conductive means comprises means forming a plurality of conductive heat paths spaced along the first conduit adjacent the warm end of the precooler.

10. The precooler of claim 9 wherein said second conduit forms a cylindrical wall and said first conduit forms a helical coil within said second conduit and conductively coupled to the interior cylindrical wall of the second conduit, and said means forming a plurality of conductive heat paths comprises a plurality of heat conductive plates conductively coupled to the exterior cylindrical wall of the second conduit at spaced locations beginning at its warm end, and said plurality of thermo-electric cooling means is located between and conductively coupled to each adjacent pair of said plurality of heat conductive plates.

11. The precooler of claim 10 wherein each of said heat conductive plates forms a substantially isothermal body, and said plurality of heat conductive plates forms a plurality of isothermal regions of decreasing temperature.

12. A method of providing a working fluid at a cryogenic temperature, comprising:

compressing the working fluid for delivery to a load;

directing the compressed working fluid to a cooling stage and placing the compressed working fluid in heat transfer relationship with working fluid leaving said load and with thermo-electric cooling means to conduct heat from said compressed working fluid in said cooling stage;

operating said thermo-electric cooling means to transfer heat from and cool said working fluid; and directing said cooling compressed working fluid to an expansion valve to deliver said working fluid at cryogenic temperatures to said load.

13. The method of claim 12 wherein heat is conducted from said working fluid at a plurality of regions spaced along the flow path of the working fluid from the warm end of the cooling stage to the cold end of the cooling stage.

14. The method of claim 12 wherein the compressed working gas is reduced in temperature by 70–150K adjacent the warm end of the cooling stage.

15. The method of claim 14 wherein the compressed working fluid is nitrogen and the nitrogen is reduced from about 300K to about 165K.

16. In a closed loop system adapted to deliver a working fluid at a cryogenic temperature to a load to be cooled, including a compressor and a Joule-Thomson valve, the improvement comprising means between the compressor and the Joule-Thomson valve adapted to precool the working fluid by heat exchange between the working fluid flowing from the compressor to the Joule-Thomson valve and the working fluid returning from the load to the compressor and by heat exchange from the working fluid flowing from the compressor to the Joule-Thomson valve and a second cooling means thermally coupled to the working fluid, said second cooling means comprising a plurality of means forming conductive heat paths that are conductively coupled to said working fluid flowing from the compressor to the Joule-Thomson valve and comprising a black body heat radiator for removing heat from the conductive heat path-forming means.

17. A precooler for a cryogenic cooling system, comprising:

means forming a first conduit to carry a working fluid from a warm end of said precooler to a cold end of said precooler;

means forming a second conduit in heat transfer relationship with said first conduit;

heat conductive means in heat transfer relationship with said first conduit adjacent the warm end of said precooler; and a black body radiator adapted to remove heat from said heat conductive means and capable of dissipating heat to space.

* * * * *